US010843030B2

(12) United States Patent
Long

(10) Patent No.: US 10,843,030 B2
(45) Date of Patent: Nov. 24, 2020

(54) WEIGHT LIFT ASSEMBLY

(71) Applicant: Marlon Long, Kirkland (CA)

(72) Inventor: Marlon Long, Kirkland (CA)

( * ) Notice: Subject to any disclaimer, the term of this patent is extended or adjusted under 35 U.S.C. 154(b) by 10 days.

(21) Appl. No.: 16/140,562

(22) Filed: Sep. 25, 2018

(65) Prior Publication Data

US 2020/0094101 A1 Mar. 26, 2020

(51) Int. Cl.
*A63B 21/065* (2006.01)
*A63B 21/00* (2006.01)

(52) U.S. Cl.
CPC ..... *A63B 21/4015* (2015.10); *A63B 21/065* (2013.01)

(58) Field of Classification Search
CPC ..... A63B 21/4015
See application file for complete search history.

(56) References Cited

U.S. PATENT DOCUMENTS 757,983 A 4/1904 Vaile
1,511,312 A * 10/1924 Alastalo ..... A63B 21/072 482/105
2,114,790 A 4/1938 Venables
2,214,052 A 9/1940 Good
2,849,237 A 8/1958 Simithis
3,343,836 A 9/1967 James, Jr.
3,517,928 A 6/1970 Shanahan
3,785,646 A 1/1974 Ruskin
4,911,434 A * 3/1990 Herring ..... A63B 21/065 482/105
5,267,927 A 12/1993 Catanzano et al.
5,551,950 A * 9/1996 Oppen ..... A61H 1/0237 128/882
5,628,714 A * 5/1997 Philipson ..... A63B 21/0552 482/102
5,632,709 A 5/1997 Walsh
5,728,032 A 3/1998 Glass
6,052,924 A 4/2000 Sabat
6,171,220 B1 * 1/2001 Lumpkin ..... A63B 21/065 482/105
6,196,950 B1 3/2001 Emick
6,592,497 B2 * 7/2003 Greenheck ..... A63B 21/072 482/46
9,017,231 B2 * 4/2015 Kosich ..... A63B 21/065 482/105
9,504,866 B2 * 11/2016 Peralo ..... A63B 21/4035
9,868,014 B1 * 1/2018 Lake ..... A63B 21/065
2012/0100967 A1 * 4/2012 Leibowitz ..... A63B 21/0023 482/124
2014/0116452 A1 * 5/2014 Ingimundarson ..... A61F 5/3715 128/882

* cited by examiner

*Primary Examiner* — Joshua T Kennedy
(74) *Attorney, Agent, or Firm* — Harness, Dickey & Pierce, P.L.C.

(57) ABSTRACT

A weight lift assembly for holding a weight includes a base member comprising an upper surface and a lower surface and a strap forming a first loop at a first end of the base member and a second loop formed at the second end of the base member. The first loop and the second loop are spaced apart by a gap. A securing member is releasably coupled to the base member in the gap between the first loop and the second loop to receive and releasably secure a weight to the upper surface of the base member.

8 Claims, 4 Drawing Sheets

WEIGHT LIFT ASSEMBLY

FIELD OF THE INVENTION

This invention relates to athletic equipment and more particularly to a weighted band to be worn around the feet of a user.

BACKGROUND OF THE INVENTION

This invention pertains to weightlifting, specifically to a device that improves the quality and number of exercises that a person can do with their legs. It is dual loop design of the strap that enables the user to easily pick up and put down weights with their feet and to change weights quickly and the strap can be quickly used and removed from the feet so they do not interfere with the user's ability to walk or to do other exercises.

While exercises for the upper body have always been easy to do and plentiful, exercises WITH the legs to target the core, back and abdominal the back and abdominal have been fewer and much more difficult to coordinate. One of the reasons for this discrepancy is the simple ability of a person to pick up and put down weights with their hands, while no such ability exists for picking up and putting weights with their feet.

This problem is normally addressed by the use of large expensive weight lifting machines. Machines called leg curl or leg extension machines take up a lot of room in the user's house and are only good for a couple of exercises. Other weight lifting machines such as donkey kick machines are more expensive and for most people require a gym membership.

Many devices have been invented for attaching weights to the user's legs or feet to increase the number of exercises that can be done. Weighted shoes have been invented which don't hurt the feet like feet weights but they make changing and removing weights difficult, and they hamper walking and other exercises because they remain heavy. U.S. Pat. No. 3,517,928 to Shanahan; U.S. Pat. No. 3,785,646 to Ruskin; and U.S. Pat. No. 6,052,924 to Sabat are examples of such shoes. Methods of adding weights to normal shoes include weights that tie into shoelaces U.S. Pat. No. 5,632,709 to Walsh and a sort of sock that fits over the shoe, U.S. Pat. No. 5,728,032 to Glass. In both of those inventions changing weights is time-consuming and difficult. All of these inventions are hampered by the limited amount of weight they can employ.

Closer to the mark have been devices that attach to shoes and which in turn receive various amounts of weight, as in my current invention. U.S. Pat. No. 2,114,790 to Venables; U.S. Pat. No. 2,849,237 to Simithis; U.S. Pat. No. 3,343,836 to James; and U.S. Pat. No. 6,196,950 to Emick are all examples of such devices. All of these devices are excellent while the user is actually doing the exercise. They all accommodate heavyweight and in one case the ease of changing weights rivals my own invention, but all have the same drawback, namely that they interfere with walking and doing other exercises.

U.S. Pat. Nos. 2,114,790 and 3,343,836 both use a very thick sole plate through which a dumbbell passes to add weight. The thickness of the sole plates makes walking awkward and makes other exercises awkward and dangerous as the user could easily "fall off their heels." They would have to be removed when the user is switching between the upper body and lower body exercises. U.S. Pat. No. 2,849,237 uses a thick sole plate as the actual weight and carries with it the same problems as above. U.S. Pat. No. 6,196,950 uses a thin sole plate but changing weights requires the user to fumble with individual weight plates instead of trading out the entire dumbbell. The sole plate is very rigid and flat and not at all conducive to walking.

U.S. Pat. No. 5,267,927 to Catanzano describes a similar device in which the sole plate is made up of a plurality of weights which can be thin but it is rigid and still awkward and is limited in the amount of weight it can incorporate. U.S. Pat. No. 2,214,052 to Good refers to an exercising boot "preferably made by casting suitable metal in a shaping form or mould." It is intended to be worn in place of shoes and not over shoes and therefore will be difficult to fit properly. Its rigid design again makes walking and other exercises difficult and dangerous.

The best inventions heretofore that are suitable for heavyweights, allow quick and easy changing of weights, U.S. Pat. No. 757,983, which discloses a shoe of substantially normal fit and construction with some parts added to accommodate the addition and quick removal of weights, even heavy weights. The mostly normal construction of invention provides comfort, safety, and convenience because they can be worn throughout the user's workout and walking and performing other exercises is still possible, and they provide a solid dependable base for a person who is standing on one foot while exercising with the other foot.

Presently the only way to add extra weight in order to do specific exercises such as pull-ups and dips is by means of a weight belt which is attached to a chain which is then attached to a barbell plate. Consequently there remains a need for, and it is the object of the current invention to provide a means for a person to quickly and easily pick up and put down heavyweights with their feet that is safe, does not hurt, and does not hamper walking or other exercises, is inexpensive, and easy to fit properly.

BRIEF SUMMARY OF THE INVENTION

In light of the disadvantages of the prior art, the following summary is provided to facilitate an understanding of some of the innovative features unique to the present invention and is not intended to be a full description. A full appreciation of the various aspects of the invention can be gained by taking the entire specification, claims, drawings, and abstract as a whole.

The current invention is a pair of thin, substantially flat, rigid but flexible platforms in the shape of a strap further consisting of straps to secure movement. The present invention provides a solution to this problem by easily securing weight at the feet area. The feet weightlifting strap not only allows the user to add extra weight and perform pull-ups and dips but also allows to perform abdominal exercises such as Hanging Knee Raises, Hanging Leg Raises, monkey bar sets, Lying Cable Reverse Crunches, Lying Cable Leg Raises etc.

According to the present invention, the feet weights are contoured so that they fit and rest upon the foot. They are placed with the feet and have a strap in the front edge to hold the weight securely in place.

An object of this invention is to provide a feet weight for a user.

Another object of this invention is to make a feet weight which is comfortable to wear and which is secured to the user so that it does not have any tendency to flop.

Further objects are to achieve the above with a device that is sturdy, compact, durable, simple, safe, versatile, reliable and efficient, yet inexpensive and easy to manufacture.

The specific nature of the invention, as well as other objects, uses, and advantages thereof will clearly appear from the following description and from the accompanying drawing, the different views of which are not necessarily to the same scale.

This Summary is provided merely for purposes of summarizing some example embodiments, so as to provide a basic understanding of some aspects of the subject matter described herein. Accordingly, it will be appreciated that the above-described features are merely examples and should not be construed to narrow the scope or spirit of the subject matter described herein in any way. Other features, aspects, and advantages of the subject matter described herein will become apparent from the following Detailed Description, Figures, and Claims.

BRIEF DESCRIPTION OF THE VIEWS OF THE DRAWING

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
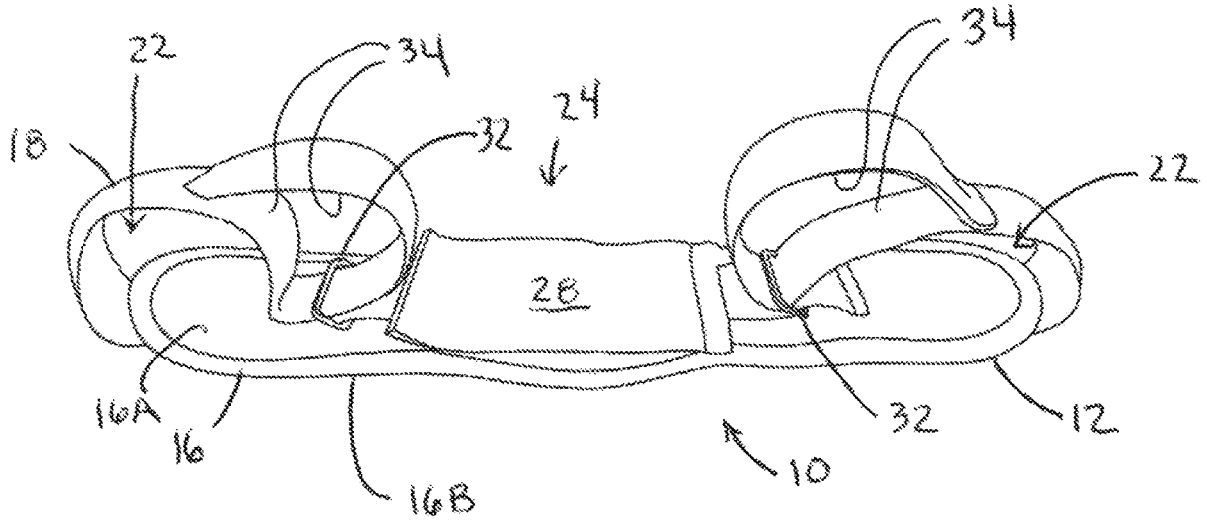
FIG. 1 is a top view of a weight lifting strap of the current invention.
Figure 2:
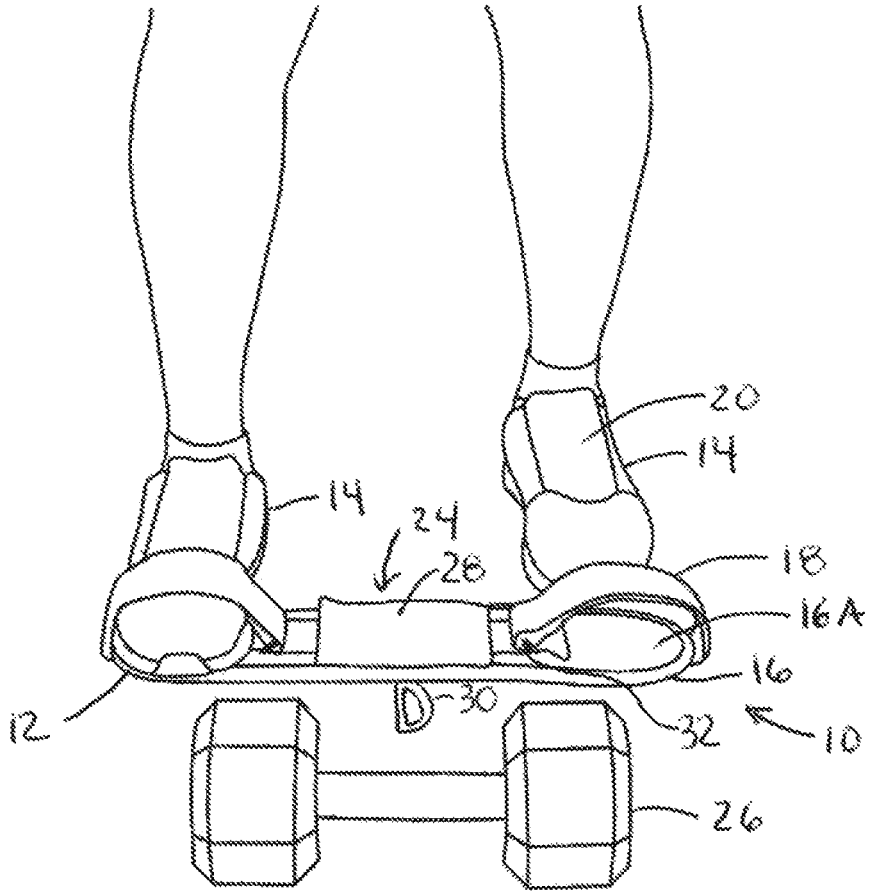
FIG. 2 is a front view of a weight lifting strap.
Figure 3:
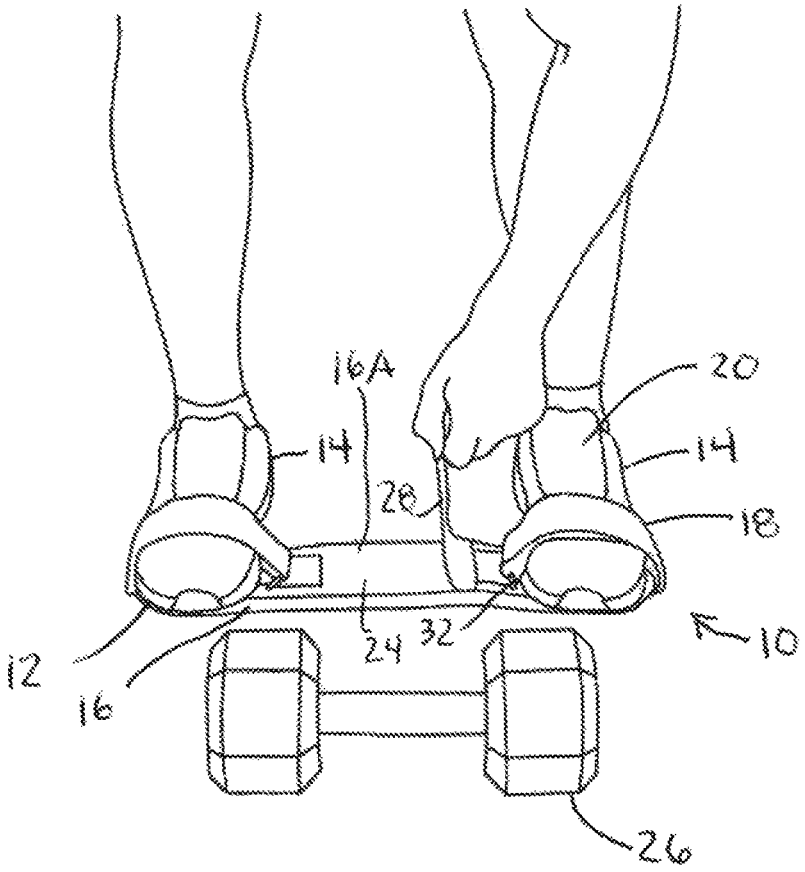
FIG. 3 is showing weight lifting strap adjusted by user.
Figure 4:
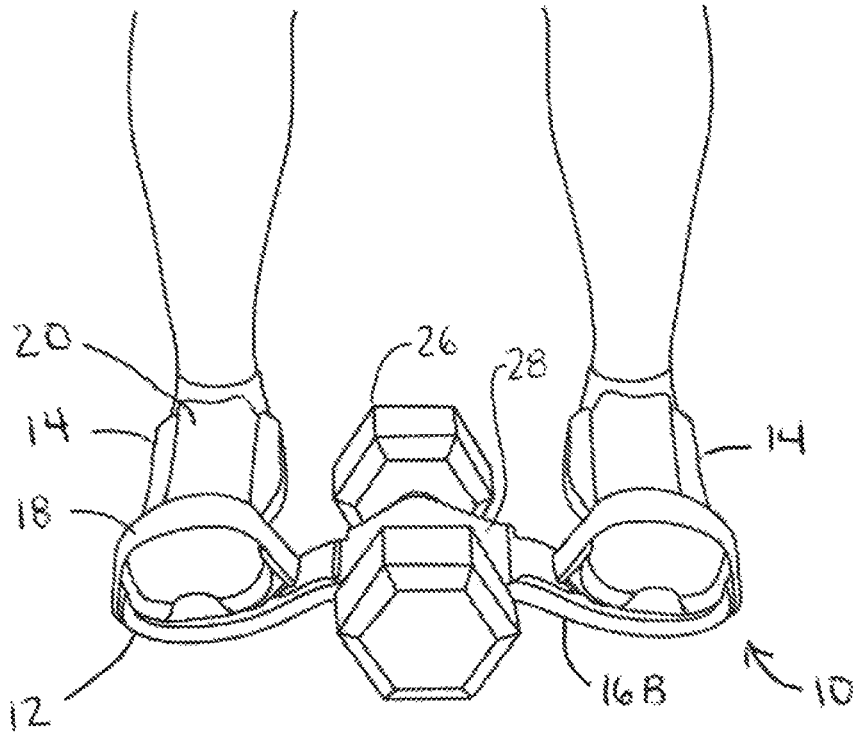
FIG. 4 is showing usability of weight lifting strap by user once ready.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DESCRIPTION OF THE PREFERRED EMBODIMENT

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Referring specifically to the drawings, a weight lift assembly 10 has a band 12. The band 12 is made of suitable material. The band 12 is placed around the feet so that it fits the natural contour of the feet 14 and rests around the surface of the foot, the band 12 being larger at the bottom than the top when strapped to the feet 14. The band 12 has a base member 16 comprising an upper surface 16A and a lower surface 16B. The band 12 has a fastening member such as a strap 18 adapted to secure the base member 16 to an article of footwear 20.

By placing feet 14 into a belt loop 22 on each end of the strap 18 and slightly tightening and securing the loop 22 around the feet 14. Once both feet 14 are in place, there will be a wide enough gap 24 between the two feet 14 in order to secure a weighted dumbbell 26 to be lifted with a securing flap or member 28 on the upper surface of the base member 16. Using a pulling motion while seated or lying is also an option by attaching a weight machine cable to the D-ring 30 that is attached to the bottom of the strap.

Straps 18 are attached to each end of the band 12 by a hook and loop system a buckle 32 is attached to one of the straps. The buckle 32 is of the sliding-jam type. This means both a hook and loop system 34 (VELCRO®) and sliding jam buckle 32 provided to loosely strap the accurate band around the feet regardless of the size of the feet. Circular pads as might be made from cloth etc are provided over the feet bone of each foot to protect the band where it protrudes in this area. These also aid in securing the straps to the band.

Velcro is attached to the lower edge of the periphery of the band in the front thereof. Using a pulling motion while seated or lying is also an option by attaching a weight machine cable to the D-ring 30 that is attached to the bottom of the strap 18.

It will be understood that the band 12 is attached to the user by strapping the band 12 around the feet 14 and allowing the weighted band 12 to rest lightly in the middle of the foot with the weighted pocket at the front and on the foot. By placing feet 14 into the belt loop 22 on each end of the strap 18 and slightly tighten and secure the loop 22 around the feet 14. Once both feet 14 are in place, there will be a wide enough gap 24 between the two feet 14 in order to secure a weighted dumbbell 26 to be lifted.

While a specific embodiment has been shown and described, many variations are possible. With time, additional features may be employed. The particular shape or configuration of the platform or the interior configuration may be changed to suit the system or equipment with which it is used.

Having described the invention in detail, those skilled in the art will appreciate that modifications may be made to the invention without departing from its spirit. Therefore, it is not intended that the scope of the invention be limited to the specific embodiment illustrated and described. Rather, it is intended that the scope of this invention be determined by the appended claims and their equivalents.

The invention claimed is:

1. A weight lift assembly for holding a weight comprising:

a base member comprising an upper surface, a lower surface, and a strap configured to secure the base member to an article of footwear;

said strap comprising a first end and a second end, said strap having a first loop formed at the first end of the strap at a first end of the base member and a second loop formed at the second end of the strap at a second end of the base member, each of said first loop and said second loop being adjustable and said first loop and said second loop being spaced apart by a gap; and a securing member coupled to the base member in the gap between the first loop and the second loop;

wherein said securing member is configured to receive and releasably secure a weight between the upper surface of the base member and the securing member.

2. The weight lift assembly as set forth in claim 1 further comprising a hook and loop fastener for securing the strap around a foot of a user at the first loop and the second loop.

3. The weight lift assembly as set forth in claim 1 further comprising a first buckle disposed at the first loop.

4. The weight lift assembly as set forth in claim 1 further comprising a D-ring attached to the lower surface.

5. A weight lift assembly for holding a weight comprising:

a base member comprising an upper surface and a lower surface;

upper surface, a lower surface, a first strap and a second strap configured to secure the base member to articles of footwear;

said first strap comprising a first end forming a first loop at a first end of the base member and said second strap comprising a second end forming a second loop at a second end of the base member, each of said first loop and said second loop being adjustable and said first loop and said second loop being spaced apart by a gap; and a securing member coupled to the base member in the gap between the first loop and the second loop;

wherein said securing member is configured to receive and releasably secure a weight between the upper surface of the base member and the securing member.

6. The weight lift assembly as set forth in claim 5 further comprising a hook and loop fastener for securing the strap around a foot of a user at the first loop and the second loop.

7. The weight lift assembly as set forth in claim 5 further comprising a first buckle disposed at the first loop.

8. The weight lift assembly as set forth in claim 5 further comprising a D-ring attached to the lower surface.

* * * * *